United States Patent [19]

Lehman

[11] Patent Number: 4,887,751

[45] Date of Patent: Dec. 19, 1989

[54] TRAVELER'S ORGANIZER BAG LUGGAGE

[76] Inventor: Michael Lehman, 1133 Van Nuys St., San Diego, Calif. 92109

[21] Appl. No.: 323,969

[22] Filed: Mar. 15, 1989

Related U.S. Application Data

[63] Continuation-in-part of Ser. No. 139,323, Dec. 30, 1987, abandoned.

[51] Int. Cl.[4] ..... A45C 3/00; A45C 5/14

[52] U.S. Cl. ..... 224/151; 224/205; 224/208; 190/1; 190/18 A; 190/110; 190/103; 190/903; 206/293; 383/4; 383/13

[58] Field of Search ..... 224/151, 208, 205, 202; 190/110, 116; 383/4, 13

[56] References Cited

U.S. PATENT DOCUMENTS

| | | | |
|---|---|---|---|
| 1,302,312 | 4/1919 | Cook | 224/205 |
| 2,224,568 | 12/1940 | Altorfer | 224/151 |
| 2,705,063 | 3/1955 | Torrent | 190/51 |
| 3,122,225 | 2/1964 | Ward | 190/52 |
| 3,256,919 | 6/1966 | Ogletree | 224/205 |
| 3,292,747 | 12/1966 | Dawson | 190/111 |
| 3,530,961 | 9/1970 | Weissenback | 190/111 |
| 3,963,102 | 6/1976 | Carp | 190/51 |
| 4,212,377 | 7/1980 | Weinreb | 190/52 |
| 4,236,657 | 12/1980 | Brunton | 224/153 |
| 4,287,971 | 9/1981 | Doulet | 224/208 X |
| 4,436,189 | 3/1984 | Baum | 190/108 |
| 4,513,866 | 4/1985 | Thomas | 190/110 |
| 4,561,576 | 12/1985 | Lowe et al. | 224/202 X |
| 4,756,394 | 7/1988 | Cohen | 190/110 |

FOREIGN PATENT DOCUMENTS 1773130 8/1954 Fed. Rep. of Germany .

OTHER PUBLICATIONS

1986/ORECK Sales brochure, p. 19 (Lower) attached.

*Primary Examiner*—William Price
*Attorney, Agent, or Firm*—Charmasson & Holz

[57] ABSTRACT

A compartmented luggage for separating a travelers belongings and allowing convenient carrying and access. A foldout flap and a plurality of compartments are detachably mounted to an outer shell avoiding mixing of various types of clothing and use outside of cartage. The luggage also has a strap arrangement allowing cartage by handles, shoulder strap or on the user's back. The strap arrangement includes a strap retractor to reel in excess strap material. Strap material can also be used to attach one of the compartments to the outer shell of the luggage. Internal straps and hooks can also be provided to secure the various compartments within the outer shell. If a larger compartment is required, smaller compartments can be removed.

16 Claims, 5 Drawing Sheets

FIG 11
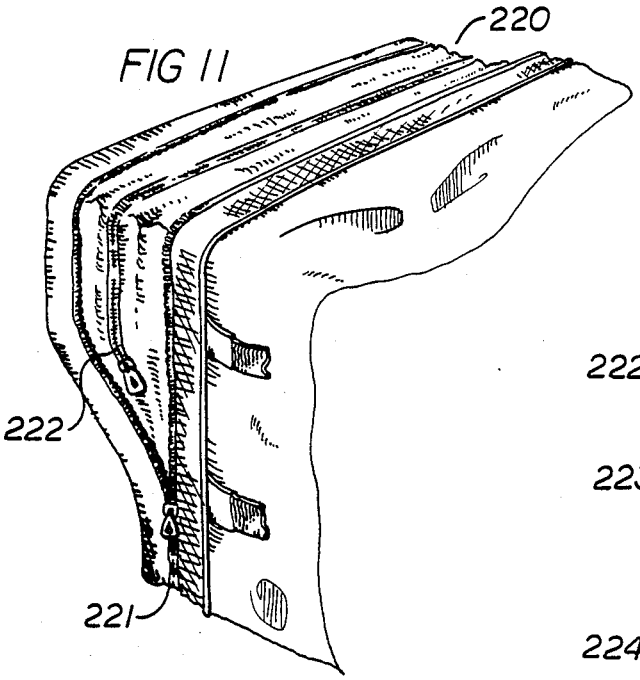
FIG 12
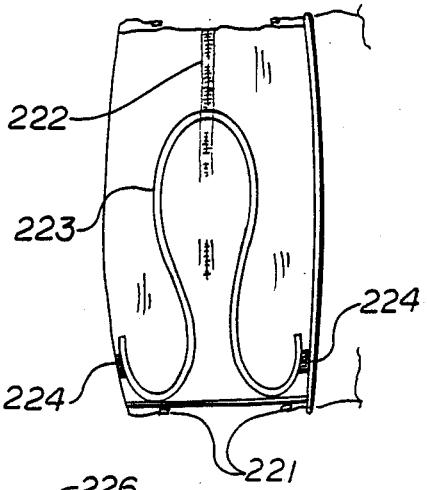
FIG 13
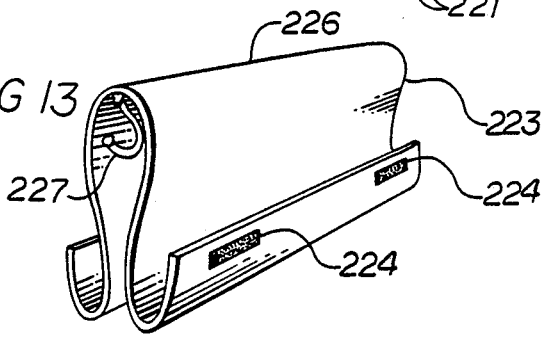
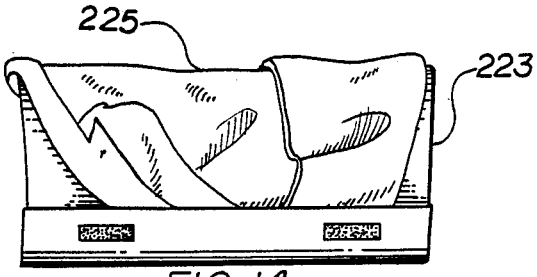
FIG 14
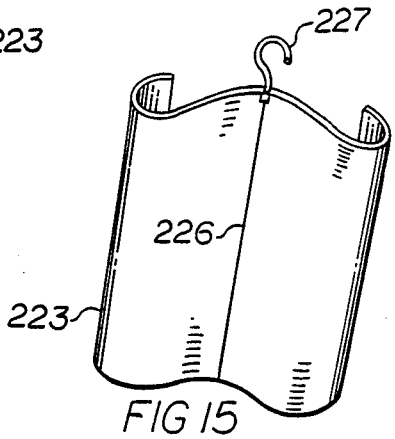
FIG 15

TRAVELER'S ORGANIZER BAG LUGGAGE

This application is a continuation-in-part of co-pending application Ser. No. 07/139,323, filed on Dec. 30, 1987.

BACKGROUND OF THE INVENTION

This invention relates to backpacks, and luggage, as well as to carry-on type flight-bags. Heretofore, travel-bags such as those having been set forth by Baum/U.S. Pat. No. 4,436,189 and Ward/U.S. Pat. No. 3,122,225, were essentially modified satchels and garment bags, or, modified backpacks such as presented by Brunton/U.S. Pat. No. 4,236,657 which provided for a wrap-around means including suitable garment-carrying ability.

For example, the typical garment carrier provision currently offered involves a laterally-folding midriff, which tends to crease jackets horizontally across the chest and arm regions, thereby creating a "ruffled traveler" look. Furthermore, while some travel-bags offer clever internal compartments, even with localized zippered openings, none offer a plurality of truly modulary rearrangeable pouches and containers capable of facilitating a wide range of needed conveniences.

SUMMARY AND OBJECTS OF THE INVENTION

The foregoing background in mind, it is an object of this invention text to provide a travel-bag of soft, frameless, sewn or stitched construction enveloping employing flexible fabrics such as nylon, canvas, or leather, which will hereinafter generically be referred to as the "fabric" having an inside and an outside surface which shall therefore remain referred to as such, even when the bag is fully unfolded, as in the "open condition" of display usage.

Accordingly, it is a further object to set forth a specialized travel-bag envelopment having essentially six sides of substantially dual-parallelized rectangular formation and slightly rounded corners, which is divisionable around one radially zippered perimeter into two substantially equal opposite halves. Said zipper preferably being a well-known two-way type of standard availability passing between mating halves of a conventional satchel-type dual-loop handgrip arrangement, whereby the affixed ends of each said handgrip loop extend further around therefrom so as to provide the customary reinforcement webbing strips upon the envelope front and back sidewall outer surfaces. Said two-way zipper has two separately sliding actions which herein facilitate a unique ability for the user to readily access virtually any internal recess of the yet substantially closed envelope merely by selectively positioning the closing point of the said slide-tangs about the three perimeter sides as desired, thereby negating opening of a zipper mouth more than is really necessary for reach-in accessibility. This said two-way zipper accessibility works in special conjunction with likewise equipped zipper arrangements furnished upon the special internal mounted stow-pouches, so as to achieve unusually convenient "closed condition" accessibility to the internal provisions.

It is another object of this invention to set forth the aforesaid travel-bag with provision of a convenient zippered-compartment within the outer backside-wall of the envelop-structure, wherein may be externally accessed certain conveniences such as the backpack-straps, an optional shoulderstrap, and two optional accessory plug-in surface-rollers. Also the opposite half frontside wall may optionally include an external removable convenience-pouch thereby forming yet another secondary-wall surface, but such a pocket addition is not actually embodied in the specifications hereof, since it is not considered to add any particular novelty value to the essential invention.

Another object of this specialized travel-bag invention is to set forth a special anchoring device, otherwise referred to as a "snag-grommet," having preferably three central merging arched traves, rather as a triskelton in plan-view, and preferably formed as a one-piece injection-molded plastic part having ample flexural quality such as modified ABS-plastic. Each of the three said ternary traves are thus able to act as snag-anchoring entities for a substantially standard "snap-hook" device, while the outwardly formed base portion thereof is defined as a radial-flange, the substantially flat body of which is preferably finished to a square outermost surface area, preferably including an outward stitching-groove entity just within the said flat body's outward rim region, so as to provide a more positively aligned sewing action relative to a sewing-machine's foot member which would preferably include a tiny leading "teat" protrusion into the said flange stitching-groove. The resulting recessed thread stitches are thus somewhat protected within the groove entity. The resulting snag-grommets serve the purpose of eliminating the necessity of employing conventional D-rings and redundant snap-buckles normally associated with backpack construction, hence allowing interchangeability of anchoring points by different functions, such as backpacking or shoulderstrap carrying.

Another object of this specialized travel-bag invention is to set forth a special alignment means by which a modular interchangeability or juxtapositional, or substitutional, arrangement of the special utility stow-pouches may be readily achieved. This modular interchangeability is accomplished via use of conventional Velcro V-mounts (of the well-known engaging hook & loop variety) arranged in a uniform manner preferably as a trilateral-format, wherein a base of two opposing V-mounts is set in opposition to a pair if conventional snap-fasteners having a third V-mount centered between said snaps. The said uniform attachment format being therefore applied to the primary inside walls of the envelope as well as to the detachable leaf-panel member (described elsewhere,) while the abbreviated leaf-panel extension portion will usually provide only the said two laterally opposed snap-fasteners with the center V-mount, as would the envelope inside-wall location preferred for the optional hygiene-kit (described elsewhere) which is situated immediately below the envelope/suspension-bar member (also described elsewhere.) The aforesaid attachment format system therefore uniquely enables the user to precisely align the various stow-pouch modules into the envelope confines relative to the said V-mount array, or, when in more of a rush, merely rather toss the stow-pouch into approximate position while leaving the dual snaps unaligned for a somewhat less secure full-engagement of the V-mounts as well.

Another object of this travel-bag invention, is to set forth a special optionally integrated telescopic-handle apparatus, comprised of a substantially full-width handlebar member set transversely above the external backpack/strapping compartment, with the said handlebar opposite ends being turned at right angles so as to extend down parallel in a bifurcated manner. Said bifurcations are each made as telescopic members in similar manner of construction commonly known to conventional hand-umbrellas, for example. Said telescopic members thereby provide two important functions: (1) allow the quick and easy deployment of said handlebar well above the normally adjacent envelope edge, whereby the user need only access a pair of identical flat rollers from the stow-compartment, insert the trundle-roller's preferable square-shanked truncheon-mount (preferably having the well-known spring-loaded ball-and-detent arrangement) into a suitably formed receiver-mount located at the lower-end of the primary support-tube from which the said tele-members substantially withdraw, by which the user thus transforms the travel-bag into a two-wheeled trundle-dolly pull-rig. This dolly is quite welcome for those longer walking treks since the lower position of the rolling travel-bag allows additional parcels or luggage to be easily carried upon the rather shelf-like ledge created by the offset relationship of the upward-extending tele-members relative to the width of the travel-bag itself. Moreover, the desirably low-riding position of the rolling travel-bag rig makes possible a convenient "free-standing" ability when the said handlebar is left in a substantially vertical attitude. Since the bottom of the bag at once lands flatly level with the bottom of the rollers upon the floor surface, yet immediately lifts well above the floor-surface as the tele-handle aggregation is tilted over forward toward an approximate 45-degree trailing angle from the walking user. Furthermore, it should be said that the two primary support tubes are separately detained relative to the envelope/sidewalls in opposed parallel manner. Both the primary tubes are outermost among the two separate tele-members, and preferably include a simple upper radial-flange, around which is freely floating washer-like hanger ring affixed to the envelope upper-edge, hence allowing the envelope unit to nicely hang from the top of the primary tubes while resting below against the downward length of the primary tube itself. Relative parallel alignment of the dual rollers is initially provided by the proper construction of the aggregate tele-tube sections which are thereby rigidly aligned with the said transverse handlebar member. Additionally, while in the stand-up attitude subsequent to having arrived at one's hotel room according to aforesaid example, the entire travel-bag envelope (replete with said tele-member sheathing portions) may be released from the remaining said primary-tubes (via release of the snap-fasteners or equivalent retentional devices) and manually raised upward from the rolling position to the upper display position, while still within the constraints of the dual tele-members as the said hanger-rings merely slide freely up with the attendant sheathing portions, the envelope assembly thus being held in this elevated position via the accessory door top-hook device which is merely set over the said handlebar. Thus elevated for display access, the travel-bag perimeter-zipper is easily opened at three sides, so as to allow the envelope-half jointed at the fourth side to be thereby folded down by gravity, and the internal leaf-panel to be released from its suspension buckles, so as to thereby substantially display the entire modular components of the travel-bag envelope confines.

Another object of this travel-bag invention is to set forth a diversity of special modularly interchangeable or deletable utility-pouch members, such as follows: (a) an open-mesh pouch (usually two) of sewn plastic construction, with substantially flat opposed side-walls joined via a permanent perimeter-band of about 2.5 inch width and having an integral zippered opening on at least two sides, and being suitable as a place for miscellaneous objects, but particularly as an aerator for damp or soiled clothing; (b) a see-in pouch of substantially imperforate sewn plastic construction, with substantially flat opposed sidewalls joined via a perimeter-band of about 2.5 inch width with an integral zippered opening on at least two sides, suitable as a place for miscellaneous objects such as clean underwear; (c) a rigid utility case (optional) of molded or vacuum-formed high-impact plastic construction, made as two inter-fitting flat box-like members, one forming the top portion, the inner one forming the bottom portion, thereby being suitable for crush protection of more fragile objects such as a shirt with a well-starched collar; (d) a semi-rigid envelope such as an attache case, suitable for use by a salesman or student; (e) an auxiliary utility pouch of abbreviated length, otherwise constructed like (b) above, suitable as a first-aid kit or hygiene case (such as a shaving kit). All said pouches being particularly arranged so that their respective zippers are accessible by the user from outside the travel-bag, especially relative to the satchel-handle side, obviating any awkward situation whereby one would have to actually unfold the travel-bag to its "opened-condition" while in transit. Even the internal two-piece conventional snap-buckles are easily disconnected if they are somewhat in the way of access to a desired item.

Another object of this travel-bag invention is to set forth a specially configured integral envelope hanging device in the form of a transverse suspension-bar (secured to the upper inside end-side edge adjacent to the zipper located upon the backpack stow-pocket) permanently enclosed within a fabric hanger-sleeve which is also permanently sewn along one side to the said edge seam region. A snag-grommet (or D-ring) is centered transversely immediately on the outside surface of the same backpack upperwall edge region where the suspension-sleeve is stitched, so as to directly transfer the gravity-load imposed by the entire envelope contents into a single snap-on doortop hanger-hood. The suspension-bar (preferably an ordinary rigid length of plastic tube capable of sustaining loads while remaining essentially straight) hanger-sleeve provides an ideal mooring place for a centrally positioned envelope folding-buckle, as well as two additional like-type plastic hanger-buckles for the purpose of holding up the special large leaf-panel which is hinged from the central joint of the opened envelope halves. These buckles are of standard male-female quick-disconnect design common to utility pack construction, in which the male portions usually includes a strap adjustment provision. Additionally, so as to better distribute the said hanging-loads imposed on the suspension-sleeve by the displayably opened envelope, special webbing strap-like tension-hinges are also provided at the right and left lateral extremes of the fabric joint otherwise holding the two zippered-open and downwardly-unfolded envelope halves together. These tension-hinges actually serve to prevent a stress-sagged load-distorted appearance, as does the upper suspension-sleeve described above. The two tension-hinges are able to self-unfold as the envelope halves open, and, as they become load-tensioned, act as a contiguous portion of the once zipper-severed side-bands (zippered-band forming the perimeter surface of the zippered closed travel-bag "envelope",) thereby substantially hanging the lowermost envelope half (during display) at the outermost lateral regions, resulting in a very proper overall appearance regardless of the weight being carried in the attached utility-pouches. When the travel-bag is closed and being carried in the satchel-handle attitude, the tension-hinge thus positioned in the upper corner also includes a conveniently detachable snap-fastener (standard type) at one end, while the opposite end remains sewn, so as to facilitate unblocked access to the envelope at that end, when the perimeter zipper is sufficiently unzipped.

Another object of this travel-bag invention is to set forth a special central joint region provisional hinge arrangement providing a rather loose-leaf-like apparatus that comprises a simple length of rigid plastic tube extending substantially the width of the internal confines, where it is situated immediately adjacent to the envelope flex-joint member which essentially joins the two zipper-separated halves of the envelope. The said hinge-tube is exposed at its central region while being secured to the said flex-joint inside surfaces via two endwardly opposed closed-ended sleeve-retention members about three inches in length each.

Another object of this travel-bag invention is to set forth a special collapsably concealed "pop-out" garment-carrying compartment made into the side-wall of the primary envelope portion, whereby a primary/-perimeter-zipper is substantially disengaged so as to thereby release a thus outwardly extending medial compartment portion including contiguous extensile wall portions arranged parallel with the said side-wall surface and joining upon an appropriately increased end perimeter-band surface, and similarly at the likewise sidewardly deployed medial side-wall; said band includes a secondary/perimeter-zipper member, affording convenient access into the thus laterally increased or expanded confines; whereby a substantially reversed sequence of the afore-described deployment operation serves to retract the pop-out compartment into its former concealed condition; plus, including an optional support-spine insert member formed as an inverted U-shape as two separable thin inter-nesting flexible plastic panels, capable of being manually slid apart until their respective end portions only remain overlapping so that they may thus interlock via Velcro-mount engagement points (one located at the apex of the inverted U, an more, each located at the opposite ends of the U-formation. Thus, the temporarily unitized support-spine becomes sufficiently elongated as to support a jacket or shirt garment merely draped spinally over the apex of the device, while the arms of the garment fall naturally into the dual lower opposed parallel arm-throughs of the support-spine unit, thereby eliminating those unsightly horizontal jacket-creases. Another feature of the support-spine system is the fact that it can be entirely withdrawn from the auxiliary expanded garment-compartment and unfolded 180-degrees so as to create an instant jacket-hanger, replete with rudimentary hanger-hook which may be snapped into a small snap-hole at the central fold-joint.

SUMMARIZED OBJECTS OF THE INVENTION (1) Basic Envelope Configuration: devised for novel outside accessibility.

(2) Accessory Stow-Compartment: for quick outside accessibility.

(3) Snag-grommet Configuration: eliminates attachment redundancy.

(4) Modular Internal-Attachment Format: via special Velcro mounts and alignments.

(5) Telescopic Handle: with independent stand-up and roller dolly capabilities.

(6) Non-Sagging Hanging: via internal suspension bar and tension-hinges.

(7) Loose-Leaf Conveniences: modular leaf-panel and modular leaflets.

(8) Concealed Auxiliary Garment-Carrier: with pop-out extensions, spinal-support, and hanger.

(9) Modular utility-pouches provided with perimeter-zipper so arranged as to provide convenient outside access.

BRIEF DESCRIPTION OF THE DRAWINGS

FIG. 11 shows a partial perspective view of an alternate embodiment having an expanding section;

FIG. 12 shows an interior side view within the expanding section;

FIG. 13 shows a perspective view of a form within the expanding section;

FIG. 14 shows a side view of the form holding a jacket;

FIG. 15 shows a perspective view of the unfolded form;

DESCRIPTION OF THE PREFERRED EMBODIMENT OF THE INVENTION

Figure 1:
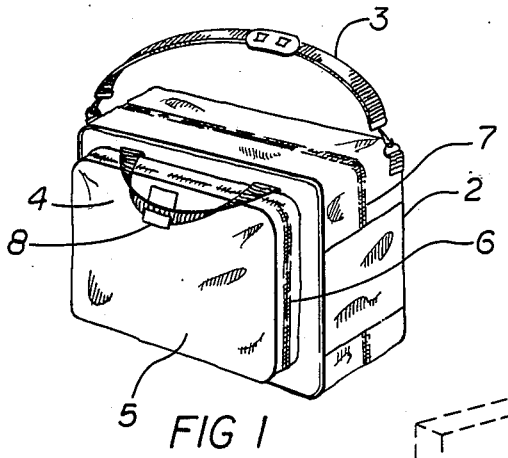
FIG. 1 shows a front perspective view of the closed multi-use travel bag.

FIG. 1 shows the preferred embodiment of the multi-use travel bag 2 in a closed condition, ready for travel. A shoulder strap 3 is attached to the diagonal corners of the top portion of the travel bag 2. A user may also hand carry the travel bag 2 by holding the first handle 4. A first outside compartment 5 is attached to the front face of the travel bag 2. Access to the first compartment is by means of the first zipper 6. Other compartments (see FIG. 3) are accessed by the main zipper 7. A Velcro snap or joining means 8 is attached to the first handle 4 and provides a means for attaching the first handle 4 to a second handle 9 (see FIG. 2). Straps and handles may be detachably connected to the travel bag 2 by hooks, snap rings or other means.

Figure 2:
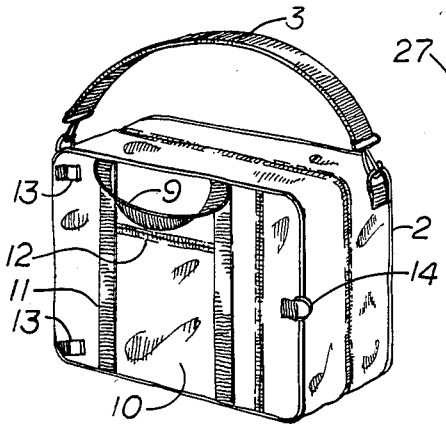
FIG. 2 shows a rear perspective view of the closed multi-use travel bag.

FIG. 2 shows a rear perspective view of the travel bag. A second handle 9 is provided and attached to the back side of the travel bag. Shoulder strap 3 is located on the top side of the travel bag 2. A second external compartment 10 is attached to the travel bag by means of webbing 11 which is an extension of the material used for the second handle 9. The webbing is stitched over the edges of the second compartment to enclose the edges to secure the second handle to the travel bag. A second outside zipper 12 is used to gain access to the second outside compartment 10. Snag grommet 13 and rings 14 provide a means for holding, attaching other straps or other means to secure the travel bag 2.

Figure 3:
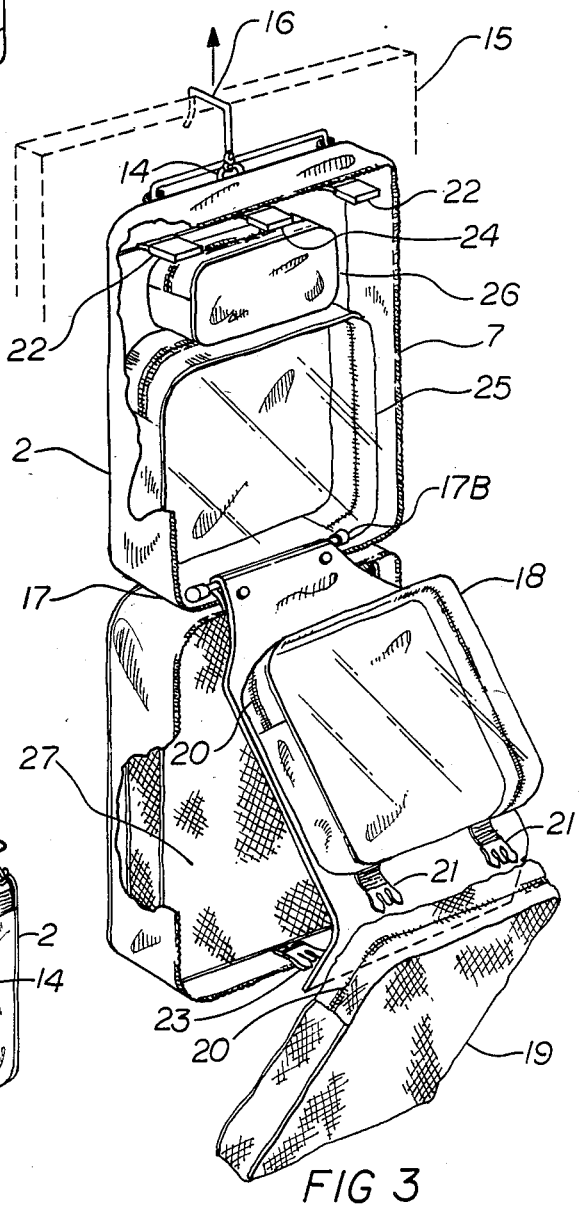
FIG. 3 shows a front perspective view of a hanging open multi-use travel bag.

FIG. 3 shows the travel bag 2 in an open hanging position. The travel bag is supported on a door 15 (shown dotted for clarity) by a top hook 16 coupled to the ring 14. Opening the travel bag is accomplished by fully unzipping the zipper 7, leaving a bottom flap portion 17 attaching the front shell portion of the travel bag to the rear shell portion. Partial unzipping zipper 7 also provides access to the interior zippers for quick retrieval. A first inside compartment 18 is rotatively attached on one side to the lower side of the travel bag or outside container shell 2. A second inside compartment section 19 is rotatively attached at one side to the opposite side of the first inside compartment 18. This allows the compartments to fold out as shown when the travel bag 2 is open.

Interior zippers 20 provide a closable means for gaining access to the interior of the first and second interior compartments 18 and 19. The first and second inside compartment sections are foldably attached by a removable bar **17*b* and shaped and dimensioned to rotate out and down when the outer shell sections are not closed, and fold into the outer shell when the outer shell is closed. A pair of snap buckles 21 are secured to a matching top catches 22 when the travel bag is closed. First shell catch 23 may be used to further secure one portion of the outside shell of the travel bag to a matching second shell catch 24. An openable third interior compartment section 25 is removably attached to the first outer shell section of the travel bag 2. The third compartment section 25 is shaped and dimensioned to be contained within the first and second outer shell sections when closed. The third compartment section is removably attached by snaps or Velcro type fasteners at the interface between the outside shell and third interior compartment. The first, second and third compartment sections are contained within said outer shell sections within the outer shell sections of the travel bag 2 when closed, and are also secured or accessed by means of interior zipper 20**.

The travel luggage also includes an openable fourth compartment section 26 removably attached to the first outer shell section. The fourth compartment section is shaped and dimensioned to fit on top of the third compartment 25 and also to be contained within the first and second outer shell sections when the other compartment sections are attached. This smaller fourth compartment allows miscellaneous toilet articles to be separately packed and also can be removed to be placed in a bathroom when not in transit. A fifth interior compartment 27 is composed of netting or other partially transparent material. The fifth interior compartment is also removably attached to the outer shell of the travel bag 2. All interior compartments are accessed by means of interior zipper 20. The open netting or transparent material allows the user to quickly ascertain the type and status of the items inside without opening the compartment.

The multiple interior and exterior access compartments of the travel bag allows separate storage of dirty and clean clothes, underwear and outer wear, shirts or other top torso garments and pants or lower body garments, causal vs. business attire, toilet articles, shoes and related items, etc. The sizes of the luggage and the compartments can be varied to suit the various usage and storage requirements.

Figure 4:
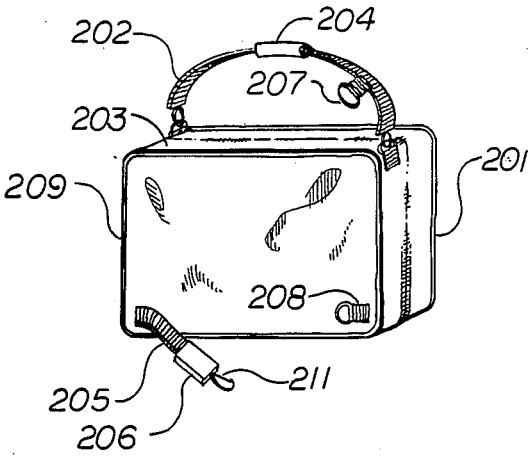
FIG. 4 shows an front perspective view of an alternate embodiment of a multi-use travel bag's straps.

FIG. 4 shows a first alternate embodiment of the strap options of a travel bag 201. For clarity, the multiple access zippers, hooks and pockets are not shown. A shoulder strap 202 is attached to one of the diagonal corners of the top panel 203 of the travel bag 201 at one end and to a side panel, proximate to the distal diagonal corner of the top panel 203. The shoulder strap 202 attachment to the corners is shown as sewn or otherwise permanently attached, but hook or other detachable strap attachment is an alternate embodiment. The shoulder strap 202 has a sliding shoulder pad 204. The sliding pad allows the bag user or traveler to carry the bag in several positions (see FIGS. 5 and 7). A multi-use strap 205 includes retractor belt mechanism 206 which can be alternately attached to shoulder strap hook 207 or bag hook 208. The multi-use strap 205 is attached proximate a first end 209 of the travel bag 201. By pulling on the belt or strap retractor 206, the hooked end 211 is extended to detachably connect to either the shoulder strap hook 207 or bag hook 208. This alternate hooked attachment allows the user or traveler to carry the bag 201 in alternate positions as shown in FIGS. 5 and 7.

Figure 5:
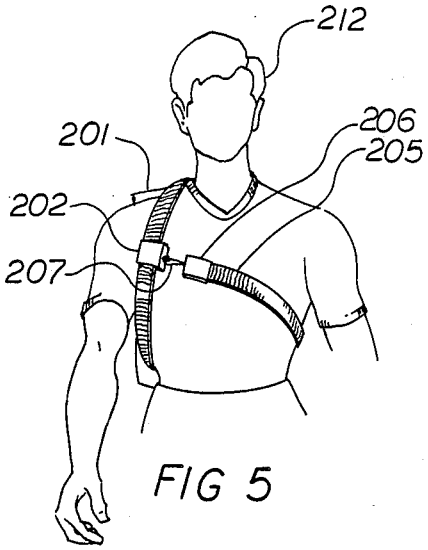
FIG. 5 shows a front perspective view of a user wearing the alternate multi-use travel bag as a back pack.

FIG. 5 shows a front view of the travel bag 201 worn as a back pack by user or traveler 212. The bag 201 is supported at three points in a diagonal fashion (see FIG. 6). The shoulder strap 202 supports the bag at two points at the user's back. The multi-use strap 205 provides the last of the three point support, being extended from retractor 206 and attached to the shoulder strap hook 207. This three point support is sufficient to support the bag on the user's back and allow free use of the user's hands. The cross strap action of the multi-use strap 205 being attached to the shoulder strap 202 creates a more secure arrangement than conventional double strap four point attachment back packs, unless the double straps are cross attached. Here, the cross strap action is combined with a supporting action of the multi-use strap. Because of the single shoulder support, the opposite shoulder and arm are fully freed from bag support requirements.

Figure 6:
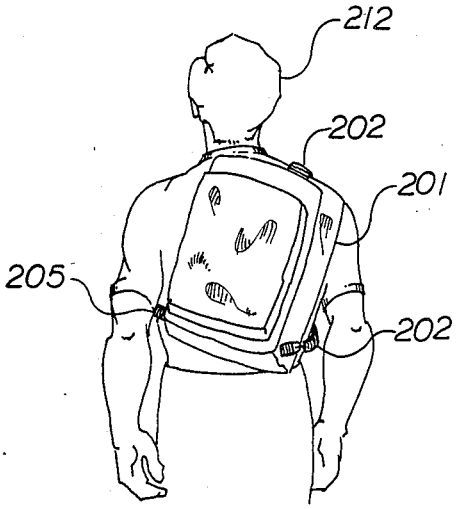
FIG. 6 shows a rear perspective view of a user wearing the alternate multi-use travel bag as a back pack.

FIG. 6 is a back view of the user and bag position as shown in FIG. 5. The bag 201 rests diagonally on the back of the user 212. Shoulder strap 202 provides two of the three points of support of the bag 201. The multi-use strap 205 provides the third point of support.

Figure 7:
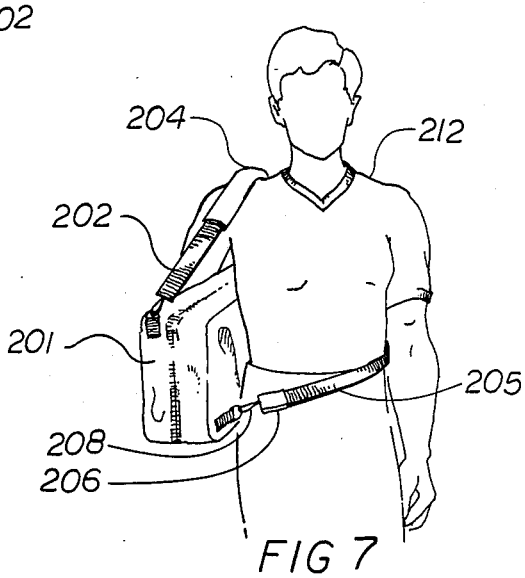
FIG. 7 shows a front perspective view a user wearing the alternate multi-use travel bag on the shoulder.

FIG. 7 shows a front view of the user 212 and bag 201 in a slung position. The shoulder strap 202 is the primary vertical two point support (one point of support hidden in this view) from one shoulder and shoulder pad 204. Multi-use strap 205 is pulled from behind the user, extending the strap from retractor 206 and attaching the free end to the bag hook 208. The multi-use strap provides primarily lateral support, minimizing the chance of swinging of the bag off the shoulder during jostling or other user movements. This lateral support allows relatively free use of both of the users hands.

Figure 8:
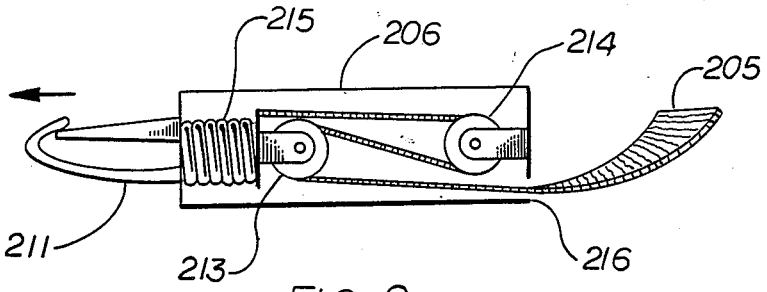
FIG. 8 shows the retractor portion of the bag.

FIG. 8 is a cross sectional view of the retractor 206. The multi-use strap 205 first passes over a spring mounted roller 213, then passes over a second roller 214 mounted to the shell casing of the retractor 206. The end of the multi-use strap is attached to the spring 215. When the user pulls out (shown by arrow), the spring extends within the retractor cavity feeding additional strap material out slot 216. Extension of the spring 215 moves the connected end and spring mounted roller 213 closer to the slot 216. Upon release of the pulling force, the spring tends to return to the position shown, retracting the strap material to within the retractor 206.

Figure 9:
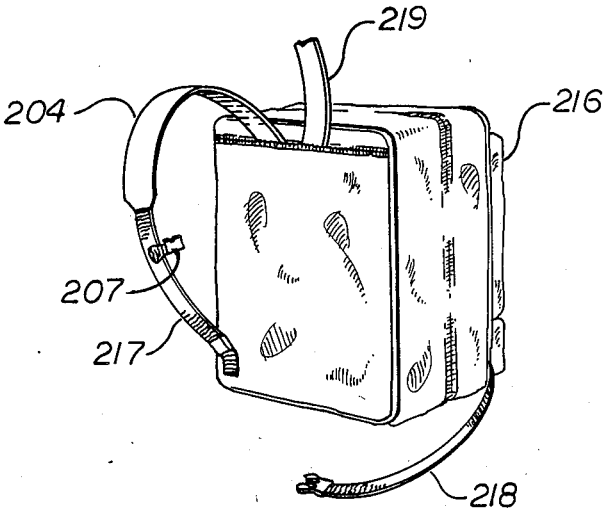
FIG. 9 shows a front perspective view of a second alternate strap embodiment of the multi-use travel bag configured as shoulder strap support.

FIG. 9 shows an alternate strap configuration. The alternate travel bag 216 has an attached alternate shoulder strap 217 and shoulder pad 204. A shoulder strap hook 207 is attached to the alternate shoulder strap 217, and when connected with the alternate multi-use strap 218, provides a similar three point support of the bag as shown in FIGS. 5 and 6. A back pack strap 219 is not attached when the alternate shoulder strap 217 is attached to the alternate multi-use strap 218.

Figure 10:
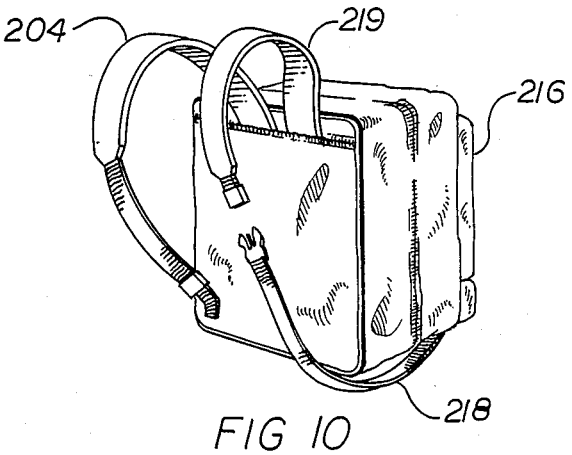
FIG. 10 shows a front perspective view of a second alternate embodiment of the multi-use travel as configured for back pack wearing.

FIG. 10 shows the alternate strap configuration about to be connected in a back pack configuration. When the alternate multi-use strap 218 is connected to the back pack strap 219, the alternate travel bag 216 can be worn on the user's back in a normal, four point support back pack configuration. The back pack strap 219 is shown without a sliding shoulder pad 204, but this may also be provided for added comfort.

The traveler's organizer bag described allows flexible cartage and use. Still further alternate embodiments may allow further flexibility of use. If a larger compartment is required, smaller compartments or the removable bar can be removed to make space within the outer shell or be replaced with a larger compartment. Detachable compartments may be separately and conveniently stored in dresser drawers between cartage. Compartments can also be separately used for side trips, business meetings, etc. Retractors may be placed on internal or other external straps to add to the convenience of using the bag. Still other compartments may be attached to the outer shell by extending internal strap materials at the edges of the other compartments.

In an alternate embodiment of the invention illustrated in FIGS. 11–15, an expandable compartment 220 is built on one side of the bag. The expandable compartment is of the accordion type, and is deployed by opening the slide fastener 221. The compartment is accessed through another slide fastener 222 which runs along the top middle section and half-way down each side.

A special form 223 is provided within the expandable compartment 220. The form is made from a sheet of semi-rigid plastic heat-formed in the shape best illustrated in FIGS. 12 and 13. Patches of hook-and-vane cloth fasteners 224 are placed along the base of the form to secure it to the inner wall of the expandable compartment. The form 223 is flexible enough to collapse down to a relatively thin profile when the compartment is folded down and slide fastener 221 is closed.

As illustrated in FIG. 14, the form 223 is designed to hold a garment such as a jacket 225 in a position that minimizes wrinkling. The form is articulated along the crest line 226, and can be opened once out of the compartment 220 to form a hanger as shown in FIG. 15.

A hanging hook 227 which is normally folded inside the form as shown in FIG. 13, is deployed when the form is used as a hanger.

Figure 16:
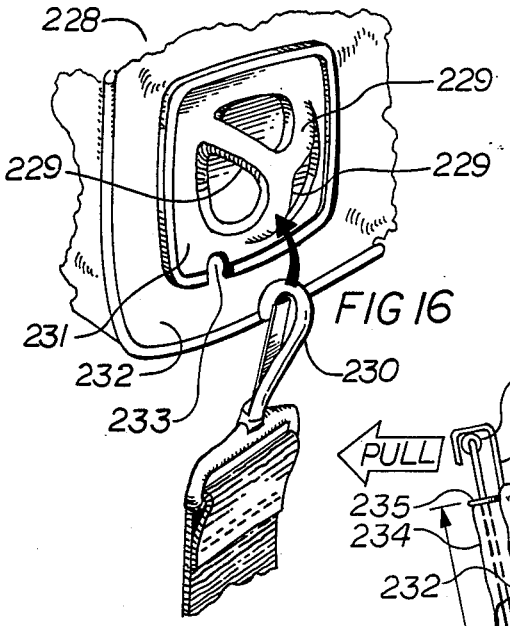
FIG. 16 shows a perspective view of a strap anchor detail.

Reference to FIG. 16 shows an enlarged general detail of the special snag-grommet 228 wherein is disclosed a preferably one-piece molded-plastic body having three arched ternary members 229 to which the conventional snag-hook 230 is seen ready for attachment. Snag-hook is shown attached to a portion of one of the straps. Notice how the flatly radiating flange 231 is made to a preferred square shape so that it may be easily stitched via sewing machine to the fabric sidewall 232, for example.

Note also how in the cut-away portion a preferred perimeter sewing-groove entity 233 is included, which serves to receive a follower-teat portion of a special sewing-foot—not seen here due to spatial restrictions—the teat would help to precisely guide the sewing-machine operator in stitching around the approximately 1.5-inch width of the squared flange.

Figure 17:
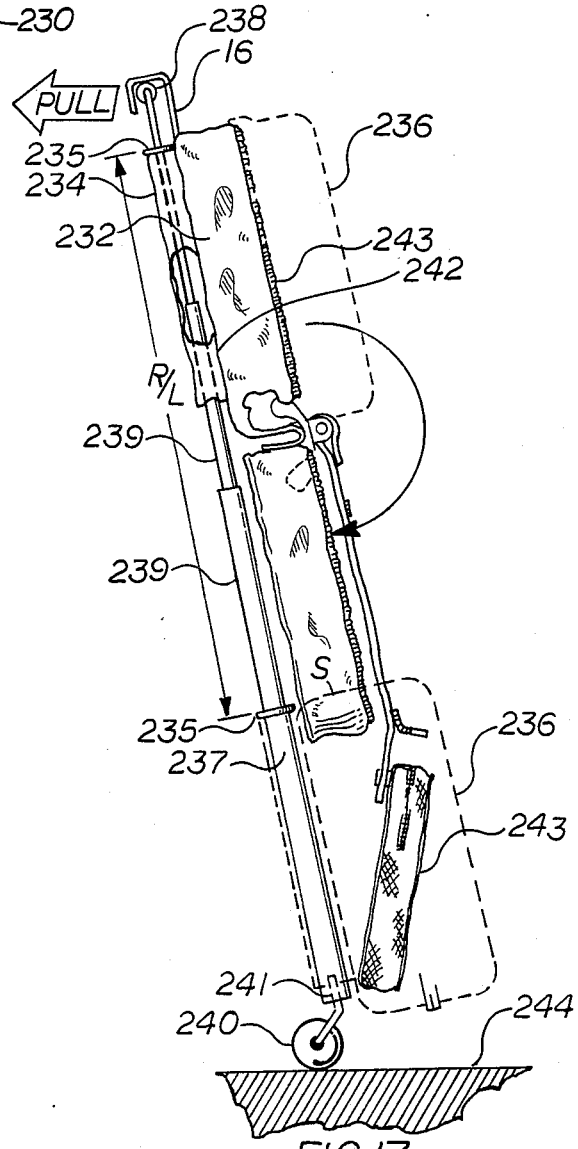
FIG. 17 shows a side view of an alternate embodiment incorporating a telescoping support/stand.

FIGS. 17 discloses an alternate embodiment having special bilateral telescopic apparatus normally substantially retracted inconspicuously into the back or the side wall 232 or external envelope while within the integrally sewn sheaths 234 having at least one hanger-ring 235 at their respective upper ends, which serve to limit the upper hanging-point of the travel-bag when it is being employed in the open mode (shown solid) or closed upper and lower dolly-rack (or rig) modality 236 of usage (shown raised and lowered, R/L positions dotted for clarity). The primary tele-members 237 are held in axial alignment via transverse handle member 238, which is well-extendible therefrom by other intersleeved members 239. Thus, simply by retrieving the twin-rollers 240 from one of the storage compartments and plugging their square end-shanks 241 into the lower ends of the primary-tube 237 a dolly is formed. In order to retain the primary-tubes 237 within their sheathings 234, an added snap-fastener may be included at the lower region, for example, whereby a portion affixed to the primary-tubes may be coupled with a portion affixed to the adjacent lower region of the shroud sheathings 234 at points 242; however, it is believed that the natural friction inherent within the said aggregate tele-members will be sufficient to hold the primary-tube aggregation properly up in the place alone. The tele-members are constructed in a substantially conventional manner known to umbrella construction, and include sufficient detents and axial-indexing as to negate collapsing under weight of the upwardly raised display condition shown in solid lines in FIG. 17, as well as the bumps and jolts to be withstood by the surface rollers 240. Additionally, the upper-ends of the primary-tubes 237 include an essential annular collar-flange proximate to the previously mentioned hanger-rings 235 land in order to limit the said lower hanging point, which provides sufficient ground-clearance when the rig is tilted-over to a normal hand-towing attitude as is shown in FIG. 17.

Once the traveler arrives in a hotel room with the wheeled doll-rig, for example, the tele-members 239 may remain extended and merely propped against the room-wall if no place for a doortop hanger is available. Once so proped, the user need only release the optional sheath/snap-fasteners 242 so as to then manually raise the entire bag assembly 236 up to its "display ready" position, thereby enabling the zipper 243 to be undone, the envelope half-sections to be opened, and the inner compartments to be disconnected allowing the compartments to be folded down 180-degrees against the lower tele-members. Notice in the dolly-rig mode of usage in FIG. 17, how the low position of the travel-bag creates a natural shelf surface (indicated "S") handy for stacking still other parcels upon, and supported over, the ground or floor surface as indicated at 244.

While the preferred embodiments of the invention has been described and modifications thereto have been suggested, other applications and modifications could be made without departing from the spirit of the invention and the scope of the appended claims.

What is claimed is;

1. Travel luggage adapted to be carried by a user which comprises:

a box-like container;

a first strap attached at two points at opposite edges of said container;

a second strap attached at one location spaced apart from at least one of said points and having a first detachable means for fastening at the other end of said second strap;

a second detachable means for fastening said first strap to said second strap; and wherein said straps and means for fastening are shaped and dimensioned to support said container on the back of said user when said first strap is placed over one shoulder and said second strap extends from proximate said back, around the opposite side of said user and is fastened to said second detachable means proximate to the front of said user.

2. The travel luggage as claimed in claim 1 which also comprises:

a third detachable means for fastening said container to said second strap; and wherein said straps and means for fastening are also shaped and dimensioned to alternately support said container at one side of said user when said first strap is placed over one shoulder of said user and said second strap extends from proximate said one side at said user's back, around the opposite side of said user and is fastened to said third detachable means.

3. The travel luggage as claimed in claim 2 which also comprises a shoulder pad slidably mounted on said first strap.

4. The travel luggage as claimed in claim 3, wherein said third detachable means for fastening said container to said second strap is attached to one end of a third strap and the other end of said third strap is attached to said container.

5. The travel luggage as claimed in claim 4 which also comprises a carrying handle.

6. The travel luggage as claimed in claim 5, wherein said carrying handle consists of a fourth and fifth strap attached to a top side of said container.

7. The travel luggage as claimed in claim 1, wherein said container is normally held by said user with an upper side in a top position and a lower side in a bottom position, said container comprising:

a first outer shell section;

a correspondingly shaped second outer shell section rotatively attached to said first shell section proximate to said lower side;

means for releasably attaching the remaining corresponding sides of said shell sections proximate to each other;

a first compartment section rotatively attached at a first side to the lower side of said container;

a second compartment section rotatively attached at one side to a second side of said first compartment wherein said second side is distal from said first side;

closable means for gaining access to the interior of said compartments; and wherein said first and second compartment sections are shaped and dimensioned to rotate out and down when said first and second outer shell sections are not attached by said means for releasably attaching, and rotate into and be contained within said first and second outer shell sections when said means for releasably attaching connects said first and second outer shell sections.

8. The travel luggage as claimed in claim 7 which also comprises an openable third compartment section removably attached to said first outer shell section, wherein said third compartment section is shaped and dimensioned to be contained within said first and second outer shell sections when said third compartment section is attached, said first and second compartment sections are contained within said outer shell sections and said means for releasably attaching connects said first and second outer shell sections.

9. The travel luggage as claimed in claim 8 which also comprises an openable fourth compartment section removably attached to said first outer shell section, wherein said fourth compartment section is shaped and dimensioned to be contained within said first and second outer shell sections when said third and fourth compartment sections are attached, said first and second compartment sections are contained within said outer shell sections and said means for releasably attaching connects said first and second outer shell sections.

10. The travel luggage as claimed in claim 9 which also comprises a means for detachably holding said first and second compartments within said outer shell sections.

11. The travel luggage as claimed in claim 10, wherein said means for detachably holding is attached proximate to said second side of said first compartment.

12. The travel luggage as claimed in claim 11, wherein at least one of said compartments is composed of transparent plastic material.

13. The travel luggage as claimed in claim 12, wherein at least one of said compartments is composed of open netting materials.

14. The travel luggage as claimed in claim 13 which also comprises a means for hanging said container.

15. The travel luggage as claimed in claim 14 which also comprises a handle composed of a strap-like material and an exterior compartment.

16. The travel luggage as claimed in claim 15, wherein said exterior compartment is secured to one of said outer shell sections by means of said strap-like material.

* * * * *